US005286303A

United States Patent [19]

Avelis

[11] Patent Number: 5,286,303

[45] Date of Patent: Feb. 15, 1994

[54] METHOD FOR DUSTING BOTTLES WITH BELT BRUSHES

[75] Inventor: Julian P. Avelis, Crete, Ill.

[73] Assignee: McBrady Engineering, Inc., East Hazel Crest, Ill.

[21] Appl. No.: 834,896

[22] Filed: Feb. 10, 1992

Related U.S. Application Data

[62] Division of Ser. No. 383,181, Jul. 19, 1989, Pat. No. 5,113,545.

[51] Int. Cl.[5] ..... B08B 1/00; B08B 1/02; B08B 1/04

[52] U.S. Cl. ..... 134/25.1; 134/25.4; 134/32; 134/21; 15/308; 15/309.2; 15/345

[58] Field of Search ..... 15/308, 309.2, 306.1, 15/345, 304, 88.2, 88.3, 88.4, 309; 134/25.1, 25.4, 32, 21

[56] References Cited

U.S. PATENT DOCUMENTS 548,341 10/1895 Wilson ..... 15/88.2
709,562 9/1902 Swan ..... 15/88.2
4,325,775 4/1982 Moeller ..... 15/88.3
4,883,542 11/1989 Voneiff ..... 134/21
5,076,303 12/1991 McBrady et al. ..... 134/21

*Primary Examiner*—R. Bruce Breneman
*Assistant Examiner*—Zeinab El-Arini
*Attorney, Agent, or Firm*—Eugene F. Friedman

[57] ABSTRACT

A cleaner for removing particulate matter on bottles moving on a conveyor line. As the bottles move along the conveyor, they contact brushes in the form of continuous, endless belts. The belt has motion relative to the bottles which it contacts. Preferably, the belt moves in the same direction, but faster than, the bottles. On the other side of the bottles, a screw auger having spaces large enough for the bottles to fit in may assure the correct motion of the bottles. Alternately, a brush also in contact with the bottles and on the other side of the belt brush may also help assure the proper cleaning of the bottles. The second brush may take the form of a rotating cylinder, a rotating auger formed of brush bristles, or even a second endless, continuous belt brush.

12 Claims, 3 Drawing Sheets

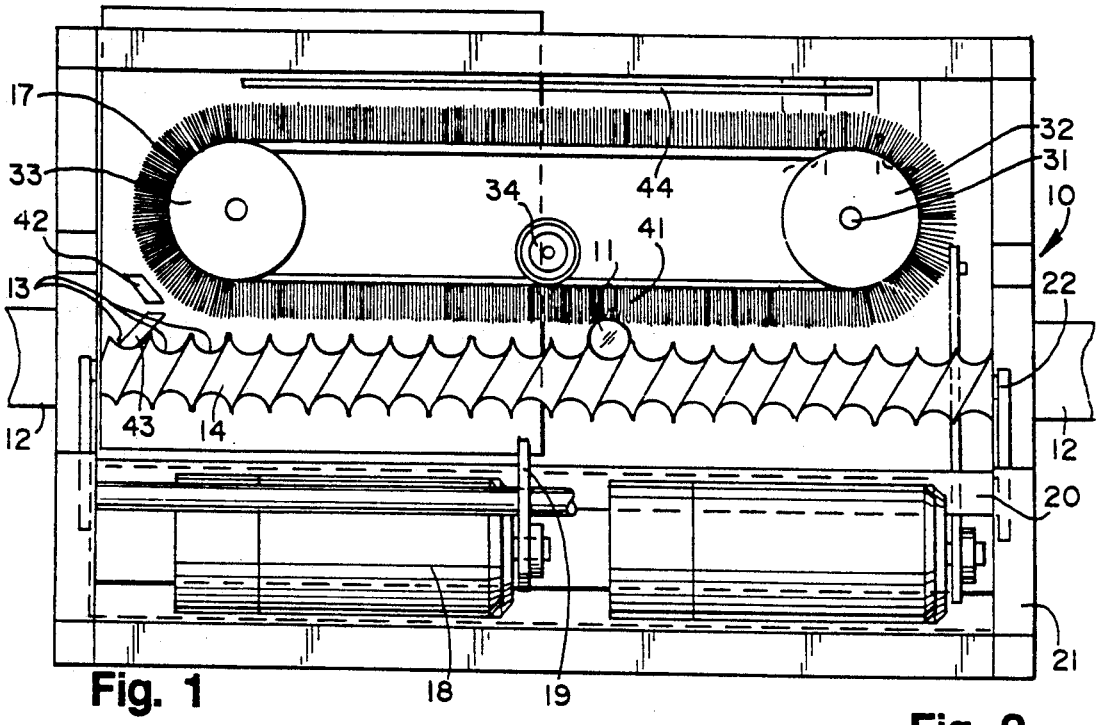
Fig. 1
Fig. 2
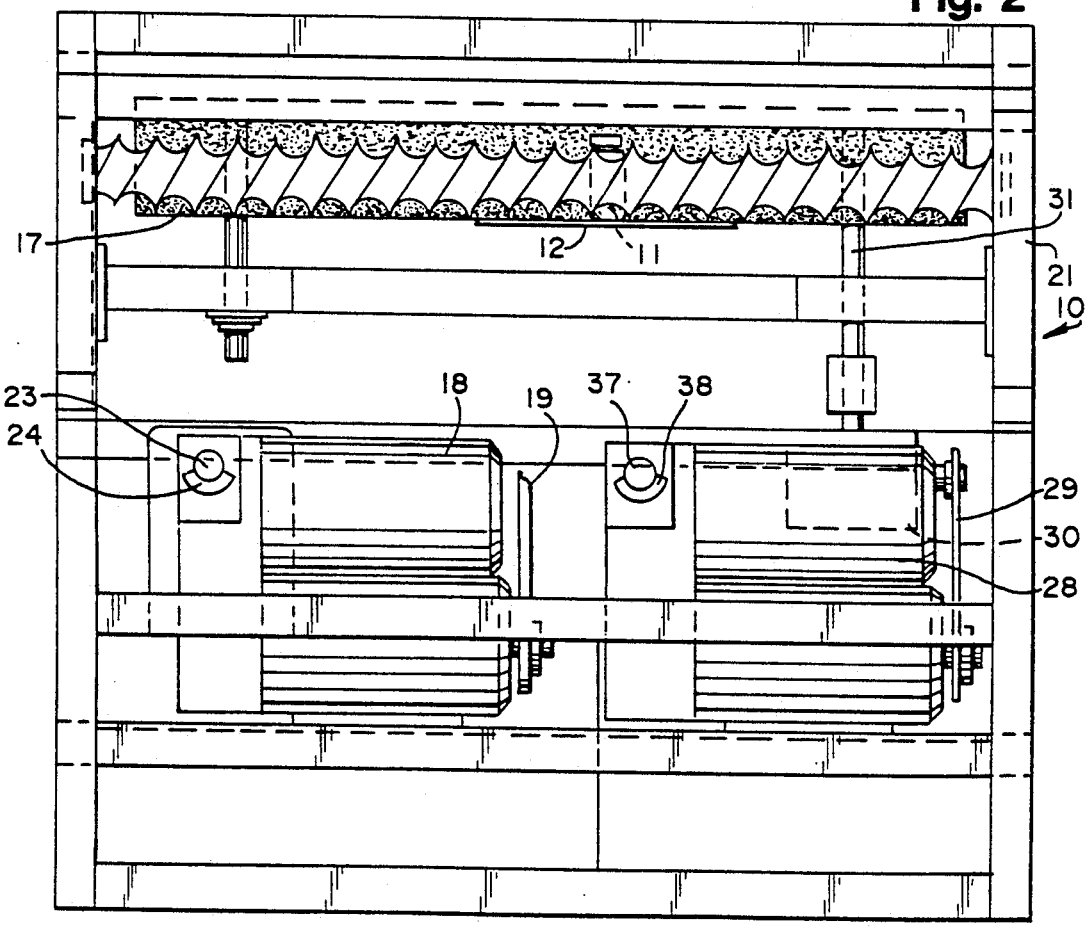

Fig. 3
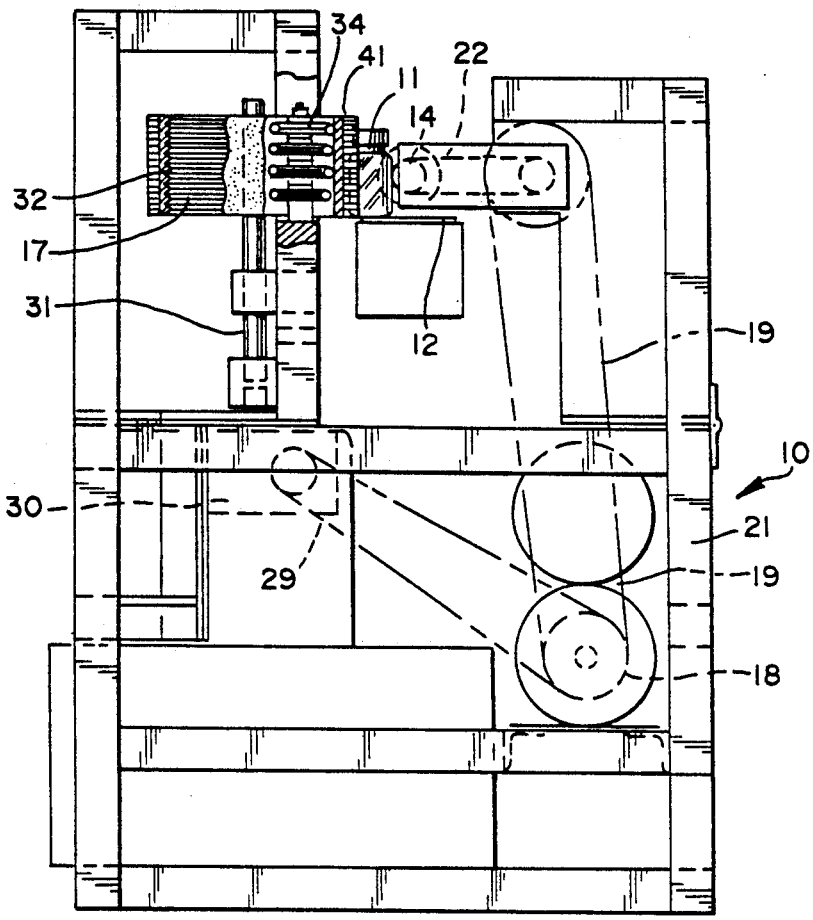
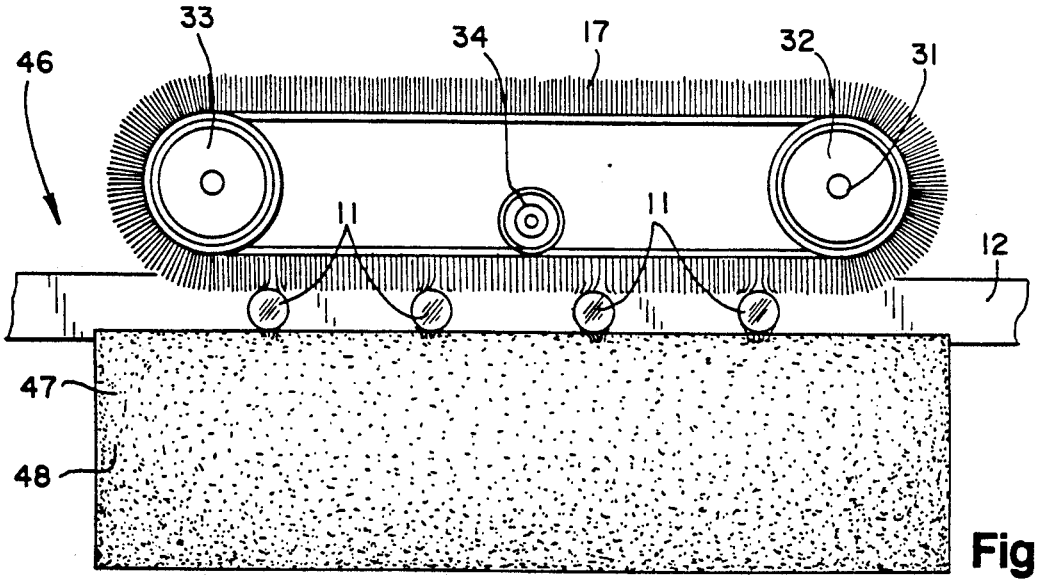
Fig. 4

Fig. 5
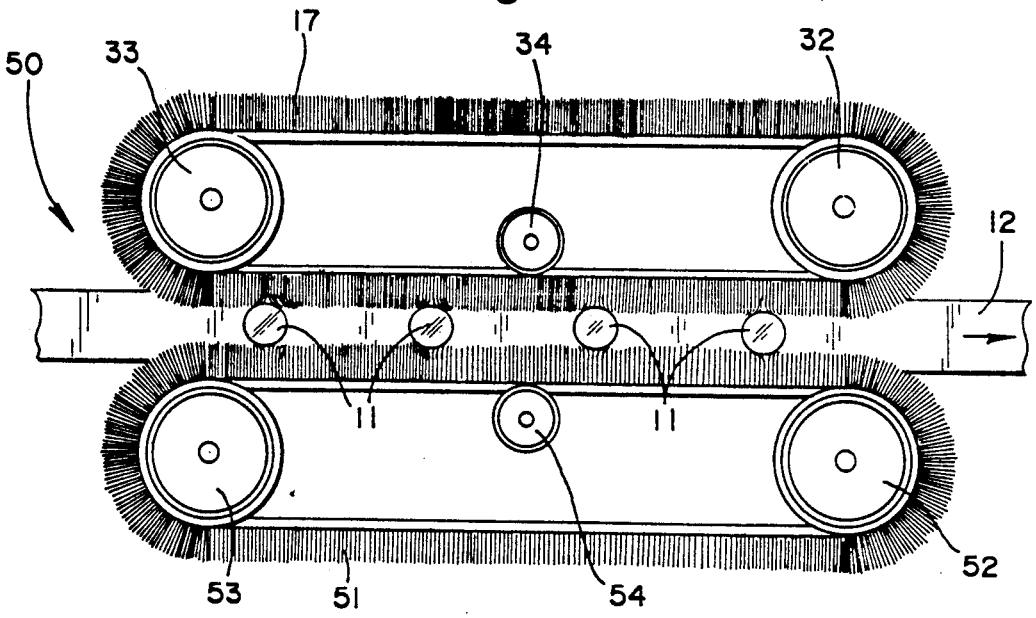
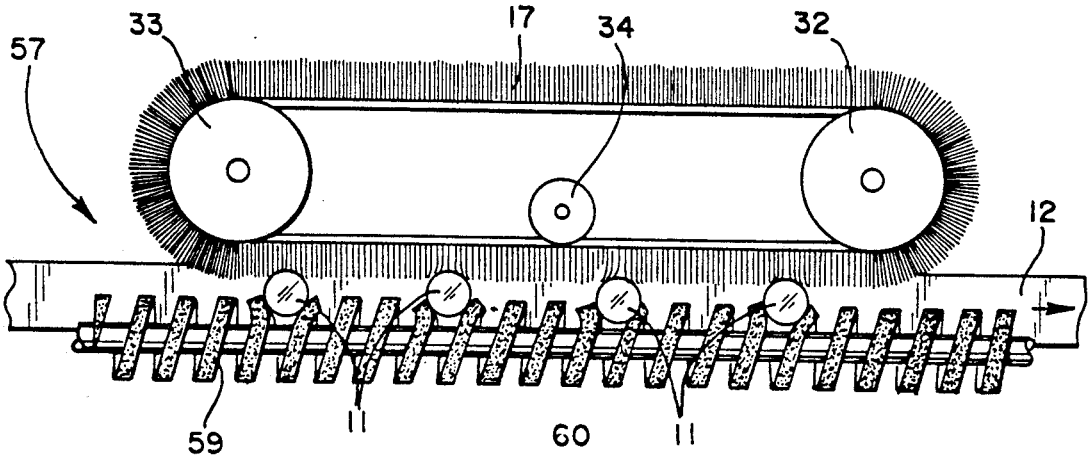
Fig. 6

METHOD FOR DUSTING BOTTLES WITH BELT BRUSHES

This is a division of application Ser. No. 07/383,181, filed Jul. 19, 1989, now U.S. Pat. No. 5,113,545.

BACKGROUND

Many times, bottles, as part of their packaging in boxes, often pass through a dust-filled environment. This will often take place where clean bottles, for example, receive a filling of powdered contents. The filling process itself causes some powder to adhere to the bottles' exterior.

The cleaning of the bottles' exteriors then constitutes a problem that must find resolution prior to placing them with their contents on sale. Such containers, having dust on their outsides, prove undesirable from a retail merchandising perspective.

William J. McBrady, and Julian P. Avelis, in their U.S. Pat. No. 4,701,973, issued Oct. 21, 1987, provided significantly improved equipment and a method for cleaning the exterior of bottles and containers. In that patent, the bottles receive a spray of ionized air while in contact with an abrading surface, most typically brushes. The ionizing air serves to neutralize the electric charge on the dust or powdered material clinging to the bottles' exteriors. A vacuum applied in the same vicinity removes the air and the particulate material dislodged by the ionized air itself or the brushes contacting the bottles.

The system and method developed by McBrady et al. has provided a significant advancement in the art of removing powdered matter from bottles' exteriors. However, the effort continues to provide even superior equipment and methods for that purpose.

SUMMARY

An improved duster for bottles' exteriors results where the abrading surface in contact with the bottles takes the form of an endless, continuous belt. Typically, the belt will assume the form of a brush and have belt bristles on its exterior surface making the actual contact with the bottles.

In general, a machine removing dust from bottles moving on a conveyor usually includes an abrading device for rubbing the bottles' surface. A motive device, coupled to the abrading device, imparts motion to it relative to that of the bottles. The conveyor moving the bottles itself has a longitudinal axis lying parallel to its direction of motion.

An improved bottle duster results when the abrading device takes the form of an endless, continuous belt. In this instance, the motive device moves the belt, while in contact with the bottles, in a direction substantially parallel to the longitudinal axis of the conveyor.

A method for cleaning the bottles moving on the conveyor with the same longitudinal axis involves contacting the bottle with an endless, continuous belt. The belt, in this instance, typically has brush bristles attached to it, with a portion of the bristles contacting the bottles. The section of the belt with the portion of bristles in contact with the bottles undergoes motion relative to the bottles. This motion occurs in a direction substantially parallel to the longitudinal axis of the conveyor.

Several distinct advantages result from the use of continuous belts, especially in the form of brushes, for removing dust from bottles. Initially, the roller brushes seen in the U.S. Pat. No. 4,701,973 to Avelis et al., mentioned above, only cleans a bottle for a short portion of its passage through the equipment. The use of several rollers as shown there results in cleaning the bottles for several relatively short passages. In comparison, a belt brush will clean a bottle for almost the entire length of its passage through the equipment.

More importantly, the bottles, when passing through the conveyor having several roller brushes, slow down at each of the brushes and speed up between them. Even a moderately unstable bottle can tip over while undergoing these changes of speed. Maintaining the bottles in contact with the brush throughout their passage through the equipment helps avoid this deleterious result.

Additionally, after the brush removes particulate matter from the bottles, it itself must undergo cleaning. Roller brushes can only do this for a short distance on their sides opposite to where they contact the bottles. A belt brush, in comparison, can have an entire side undergo cleaning for almost its entire length of travel when out of contact with the bottles. For this reason too, a belt brush represents a significant improvement in the removing of particulate matter from bottles.

BRIEF DESCRIPTION OF THE DRAWINGS

FIG. 1 gives a top plan view of a bottle duster utilizing a belt brush and a screw auger.

FIG. 2 provides a front elevational view of the bottle duster of FIG. 1.

FIG. 3 gives a side elevational view, from the left side, of the bottle cleaner seen in FIGS. 1 and 2.

FIG. 4 shows schematically a bottle cleaner utilizing, on one side of the bottles, a belt brush and, on the other side, a cylindrical, rotating brush.

FIG. 5 provides a diagrammatic view of a bottle cleaner using two belt brushes on either side of the bottles undergoing cleaning.

FIG. 6 shows a bottle duster utilizing a belt brush on one side of the bottle and, on the other side, a rotating brush in form of a screw auger.

DETAILED DESCRIPTION

The bottle duster shown generally at 10 in FIGS. 1 to 3 operates upon the bottles 11 moving along the conveyor 12 which carries them from the left to the right as shown in FIGS. 1 and 2. As the bottles enter the cleaner 10, they fit into the interstices 13 of the screw auger 14. The interstices 13 have a somewhat larger size than the bottles 11 which, accordingly, can fit into them. As seen in FIG. 3, the auger 14 turns to the right to achieve the correct movement of the bottles 11.

In particular, the auger 14, in addition to moving the bottles along the conveyor 12, urges them against the belt brush 17. In fact, the auger 14 pushes the bottles 11 against the belt brush 17 with sufficient force to make sure of intimate contact and thorough cleaning.

The motor 18 provides power for the screw auger 14. Specifically, it drives the belt 19 which in turns serves to rotate the jack shaft 20 journalled to the frame 21. The jack shaft 20, in turn, drives the belt 22 which serves to turn the auger 14. The knob 23 controls the speed of the motor 18, and the dial 24 shows the resulting r.p.m.

Similarly the motor 28 drives the belt 29 which couples to the gear box 30 to rotate the vertical shaft 31. The vertical shaft 31, in turn, rotates the wheel 32 in the counterclockwise direction seen in FIG. 1. The drive wheel, in turn, causes the belt brush 17 to also rotate in the general counterclockwise direction. The idler wheel 33 and the tensioner 34 keep the belt brush 17 taut and urged against the bottles 11.

The knob 37 controls the speed of the motor 28 and thus the belt brush 17. It should provide a sufficient speed, as indicated on the meter 38, to make sure that the belt 17 moves faster than the bottles 11. In other words, in FIG. 1, the lower portion 41 of the belt 17 sits in contact with the bottles 11. However, it moves to the right faster than the bottles 11 themselves. It thus imparts a slight twisting motion to the bottle 11 while cleaning them. Furthermore, having the lower belt portion 41 move in the same direction as the bottles 11 helps introduce them into the space between the belt 41 and the auger 14 with a minimal likelihood of toppling or other disturbances.

As the bottles enter in the cleaner 10, they receives a spray of ionized air from the nozzle 42. The vacuum nozzle 43 helps remove any excess air and dust immediately dislodged. Additionally, on the backside of the brush 17, the vacuum bar 44, in effect, vacuum cleans the belt brush 17.

In the duster 46 of FIG. 4, the bottles 11 continue to move along on the conveyor belt 12. As with the duster 10 in FIGS. 1 to 3, they have the belt brush 17 cleaning them on one side. On the other side, instead of the auger 14, the duster 46 includes the cylindrical brush 47. This brush simply rotates about its longitudinal axis 48. The combination of brushes 17 and 47 seen in FIG. 4 appears to provide excellent cleaning for most types of bottles.

The duster shown generally at 50 in FIG. 5 includes the belt brush 17 and its associated components as seen in FIGS. 1 to 4. On the other side of the bottles 11 moving on conveyor 12 appears the second belt brush 51 with its idler and drive wheels 52 and 53 and tensioner 54. These would operate in the same fashion as their counterparts for the brush 17.

In FIG. 6 appears generally the duster 57 with the belt brush 17 operating on the bottles 11 moving on the conveyor 12. On the other side of the bottles 11 appears the brush 59 which, as seen, takes the shape of an auger. The threads 60, composed of brush bristles, served to both clean the bottles 11 and move them to the right in the figure as shown.

Accordingly, what is claimed is:

1. A method for dusting bottles moving on a conveyor having a longitudinal axis, said method comprising:

(A) contacting said bottles over a substantial length of its passage on said conveyor with an endless continuous belt having brush bristles attached thereto, with a portion of said bristles contacting said bottles; and (B) moving the section of said belt with said portion of bristles in a direction substantially parallel to said axis.

2. The method of claim 1 wherein said belt, wherein contact with said bottles, is in the form substantially of a plane.

3. The method of claim 2 wherein said longitudinal axis and the direction of motion and the height of said bottles all lie parallel to said plane.

4. The method of claim 3 wherein said section of said belt is moved in a direction substantially parallel to the motion of said bottles on said conveyor.

5. The method of claim 4 further including ionizing a stream of air and directing said stream of ionized air on said bottles.

6. The method of claim 5 further including removing air in the vicinity of said brush bristles.

7. The method of claim 3 further including rotating a screw auger having an axis of rotation lying parallel to said longitudinal axis about said axis, said screw auger having indentations therein between the screw threads larger than said bottles.

8. The method of claim 3 further including rotating a brush in the form of a screw auger, in contact with said bottles, about a rotational axis lying parallel to said longitudinal axis.

9. The method of claim 3 further including rotating a brush in the form of a cylinder, in contact with said bottles and located on the opposite side of said bottles from said belt, about an axis of rotation lying parallel to said longitudinal axis.

10. The method of claim 3 wherein said belt is a first belt and further including moving a second endless, continuous belt on the other side of said bottles from said first belt, while in contact with said bottles, in a direction substantially parallel to said longitudinal axis.

11. The method of claim 10 wherein said plane is a first plane and said second belt, where in contact with said bottles, forms substantially a second plane.

12. The method of claim 11 wherein said second plane is substantially parallel to said first plane.

* * * * *